US006437678B1

(12) United States Patent
Konz

(10) Patent No.: US 6,437,678 B1
(45) Date of Patent: Aug. 20, 2002

(54) ELECTRIC NOISE ABSORBER AND METHOD FOR ITS ASSEMBLY WITH A CABLE

(75) Inventor: Oliver Konz, Ilshofen (DE)

(73) Assignee: Wuerth Elektronik GmbH & Co. KG (DE)

( * ) Notice: Subject to any disclaimer, the term of this patent is extended or adjusted under 35 U.S.C. 154(b) by 0 days.

(21) Appl. No.: 09/527,632

(22) Filed: Mar. 17, 2000

(30) Foreign Application Priority Data

Mar. 22, 1999 (DE) ..... 199 12 917

(51) Int. Cl.[7] ..... H01F 27/24
(52) U.S. Cl. ..... 336/233; 336/174; 336/92
(58) Field of Search ..... 336/174, 175, 336/176, 92, 233

(56) References Cited

U.S. PATENT DOCUMENTS

| | | | | |
|---|---|---|---|---|
| 4,972,167 A | * 11/1990 | Fujioka | 336/92 |
| 5,162,772 A | * 11/1992 | May | 336/92 |
| 5,343,184 A | * 8/1994 | Matsui et al. | 336/92 |
| 5,355,109 A | * 10/1994 | Yamazaki | 336/92 |
| 5,942,964 A | * 8/1999 | Takeuchi | 336/92 |

FOREIGN PATENT DOCUMENTS

| | | |
|---|---|---|
| DE | 28 15 920 | 10/1979 |
| DE | 43 02 650 | 8/1993 |
| DE | 295 15 545 | 1/1996 |
| DE | 195 36 155 | 4/1997 |
| EP | 0 257 179 | 4/1996 |

* cited by examiner

*Primary Examiner*—Elvin Enad
*Assistant Examiner*—Kyung Lee
(74) *Attorney, Agent, or Firm*—Akerman Senterfitt

(57) ABSTRACT

Noise absorbers (11), which comprise two casing halves (16,17) foldable together around a cable and containing ferrite half-rings, are fixed to a cable (13) in that, prior to the closing of the casing halves, the cable is pressed between two parallel fixing edges (34) of a fork-like projection (32) on one casing end wall (21). The two legs (33) of the fork project over the casing parting line (27), but pass in front of the end wall (21) of the second casing half (17). The cable is laterally compressed somewhat by the substantially parallel faxing edges (34), which ensures a reliable longitudinal fixing to the cable, which does not damage the latter, of the noise absorber made relatively heavy by the elements.

Assembly is significantly facilitated in that the definitive fixing takes place prior to the closing of the casing halves and following the folding together of the casing halves no elastic bursting force remains, which attempts to force apart said casing halves. This also ensures a good contact between the two halves of the ferrite elements, whose ring closure is particularly important for the action.

28 Claims, 4 Drawing Sheets

ELECTRIC NOISE ABSORBER AND METHOD FOR ITS ASSEMBLY WITH A CABLE

BACKGROUND OF THE INVENTION

The invention relates to an electric noise absorber and to a method for its fixing to an electric cable. It is known that by means of ferromagnetic material elements surrounding an electric line or cable, it is possible to reduce interference effects, particularly background electric noise.

EP 257 179 B2 discloses a noise absorber, whose ferromagnetic elements in the form of half-rings are contained in a centrally split, folding casing. At the casing through openings, through which the cable passes into and out of the casing, are fitted a plurality of teeth, which engage in the cable and fix the casing to the cable. As such noise absorbers assemblable with a cable are normally intended to be suitable for a certain cable diameter range, the teeth engage to a greater or lesser extent in the cable. The necessary clamping force must be applied on closing the casing halves. It always attempts to force the two casing halves apart and stresses the closure and the film hinges between the casing halves. In particular, this can lead to the unlocking of the casing halves, so that the two ferromagnetic material elements are not in tight engagement with one another by their joint faces, which considerably reduces the effectiveness of the noise absorber.

The applicant has therefore developed a fundamentally different system which, in place of teeth, functions with in each case a single, relatively thin, round, truncated pin, which is so flexible that it can adapt to different diameter shapes. This system operates much better than that of EP 257 179. It is intended to be further developed by the present invention.

DE 43 02 650 A1 discloses a two-part noise absorber, which has at each of the through openings in the interior of the casing two flexible cable holders, which extend via the casing parting line into the area of the facing casing half. The cable is loosely inserted between said cable holders. On closing the casing half corresponding guidance or cam faces on the other casing half act on said cable holders, bend them together and in this way firmly clamp the thus inserted line bundles. Therefore the cable holders prevent the individual conductors falling apart prior to the closing of the casing halves. However, the clamping force is here again applied through the closing of the casing halves, so that the disadvantages of the first-described construction still exist.

On assembling the noise absorber with the cable, the cable must be inserted in one of the two casing halves, so that it is located in the centrally split cable passage duct in the ferromagnetic element and consequently extends through the two casing through openings. The second casing half is then folded over and is e.g. closed by a snap-in or drop-in closure. It must be precisely ensured that the cable does not pass between the ferrite elements, which would lead to the casing bursting open or to the damage to the closure or which would make closure impossible. Thus, great attention must be paid during assembly, which is tedious.

OBJECT OF THE INVENTION

The object of the invention is to provide an electric noise absorber and a method, which facilitates the assembly of the noise absorber with a cable and makes it independent of accidents or special skill. The casing closing function is in particular to be facilitated, while improving the casing structure.

BRIEF DESCRIPTION OF THE INVENTION

The method according to the invention, in which the fundamental fixing of the cable takes place prior to the closing process on inserting the cable in one of the casing halves is advantageous for assembly in that the latter can be subdivided into two time-succeeding and/or place-succeeding steps, namely pressing in and therefore fixing of the cable in one casing half and the following step of closing the casing halves. The closure and the hinges between the two casing halves are not permanently influenced by the clamping force for fixing the cable. Even if, as is possible, fixing edges are provided on the second casing half shell between which the cable can be wedged, then the clamping force is limited to the moment of closing the casing half shells. To the extent that the cable has been pressed between the fixing edges, the system is once again free from forces. This in particular avoids that the force exerted by the cable on the casing and which attempts to force the latter apart, widens the gap between the ferromagnetic elements over the course of time, because plastics are known to have a slow flow under permanent force action.

Thus, the noise absorber according to the invention has fixing edges, which have a mutual spacing such that also the smallest cable for which the noise absorber is still intended, is jammed between the fixing edges on pressing in. Normally a noise absorber is intended for cables, whose diameter differs by roughly 2 mm. The spacing between the fixing edges should be e.g. 0.2 to 0.3 mm smaller than the smallest of said cable diameters. This ensures that also such a cable is well wedged and that the thickest cable can still be relatively easily pressed in. Through the complete avoidance of teeth, damage to the cable is prevented. The cable is only partly flattened and forms in its flexible insulating material two circumferentially directed, narrow flattened portions. There is no need to reduce the cable cross-section and it is instead only brought into the shape of an oval or an elongated hole, which as a result of the provision of individual, mutually insulated conductors in an insulating jacket can take place easily and without any damage. Even if force is exerted, e.g. when the noise absorber is caught on a piece of furniture on drawing through a cable, this does not lead to any damage to the cable, but at the most to a displacement of the noise absorber.

The fixing edges should be substantially parallel to one another, or at least should not diverge from parallelism than is ensured by the automatic locking of the cable between them. This also applies if the fixing edges or the strips or ledges carrying them are somewhat flexible in a certain area, e.g. the area projecting over and beyond the casing parting line. However, the flexibility must not be too great, so that the clamping force can be maintained without additional measures.

The fixing edges can be very narrow, but should not be sharp, so as to avoid damage to the cable on pressing in. The faces of the fixing edges should be straight and untoothed. However, a certain surface roughness is possible.

Preferably the fixing edges are constructed outside the actual casing, particularly outside the casing through openings. That part of the fixing edges projecting over and beyond the casing parting line plane can be free in front of the casing outer wall. The shape of the casing through openings is unimportant. When the casing is assembled they can be smooth circular and should have a diameter which at least corresponds to that of the largest intended cable. However, they also have a guidance function for the cable, so that the latter is appropriately oriented with respect to the ferromagnetic elements, but fulfil no axial fixing function. When the casing is closed the casing through openings on the open side of the two fixing edges have an additional radial securing effect.

Thus, the cable is definitively axially fixed by the fixing edges at the time of pressing in, namely by a mixed force and positive closure (due to the cable constriction). It is also radially positively fixed with respect to a degree of freedom (transverse to the fixing edges) and non-positively fixed in the direction perpendicular thereto, namely by frictional engagement between the fixing edges.

Thus, on closing the casing, during design and assembly the main attention can be directed at the matching of the casing to the optimum contact between the two seatings of the ferromagnetic elements. Thus, an easily assemblable, highly operationally reliable, efficient noise absorber is obtained.

Thus, in a preferred embodiment a noise absorber is obtained, which comprises two casing halves can be folded round a cable and containing ferrite half-rings therein. It is fixed to a cable in that prior to the closing of the casing halves is pressed between two parallel fixing edges of a fork-shaped projection on a casing end wall. The two legs of the fork project over the casing parting line, but pass externally in front of the end wall of the second casing half. The cable is laterally compressed somewhat by the substantially parallel fixing edges, which ensures a reliable longitudinal securing on the cable of the noise absorber made relatively heavy by the elements and which does not damage the cable.

Assembly is significantly facilitated in that definitive fixing takes place prior to the closing of the casing halves and no elastic bursting force remains after the folding together of the casing halves which would attempt to press the latter apart. This also ensures a good contact of the two halves of the ferrite elements, whose ring closure is particularly important for the action.

In the case of flat cables the prefixing of the cable in the casing recess and particularly the recess between the ferrite halves is particularly important. In the prior art It constantly arises that the flat cables slide between the lateral legs of the ferrite halves and consequently prevent a ring closure of the ferrite, which is important for the function.

The invention here creates a possibility of so fixing the cable to the lower casing half that on closing the casing there is no need to fear any displacement. If at all, on closing the casing only a certain clamping action is exerted on the flat cable* which inter alia ensures that the flat cable does not curve up within the noise absorber. However, the main retaining action is brought about by hook-like fixing elements, which in the manner of angle levers are in each case externally shaped onto a casing half and with a cam-like projection define a clamping gap in which can be slid the flat cable as a result of an introduction bevel. The ends of the clamping gap, which are usually bounded by the fixing element, bring about a stop action of the flat cable in the vicinity of both front faces of the casing, so that the cable is guided along the edge of the in this case flat, slot-like cable passage opening. A cam on the fixing element engages in the usually present grooves between the individual flat cable conductors and ensures a good transverse securing, while the axial securing is in part achieved by the clamping action on the flat cable and in part by a slight wavy deformation of the flat cable. As with such flat cables the insulations are particularly thin, it is important that there is no need for a penetration of the cable insulation for retention purposes.

These and further features can be gathered from the claims, description and drawings and the individual features, both singly or in the form of sub-combinations, can be implemented in an embodiment of the invention and in other fields and can represent advantageous, independently protectable constructions for which protection is claimed here. The subdivision of the application into individual sections and the subtitles in no way limits the general validity of the statements made thereunder.

BRIEF DESCRIPTION OF THE DRAWINGS

An embodiment of the invention is described in greater detail hereinafter relative to the attached drawings, wherein show.

DESCRIPTION OF PREFERRED EMBODIMENTS

With the exception of the differences stressed hereinafter, the noise absorbers according to FIGS. 1 to 4 and 5 to 7 are of the same design, so that a joint description is provided.

Figure 1:
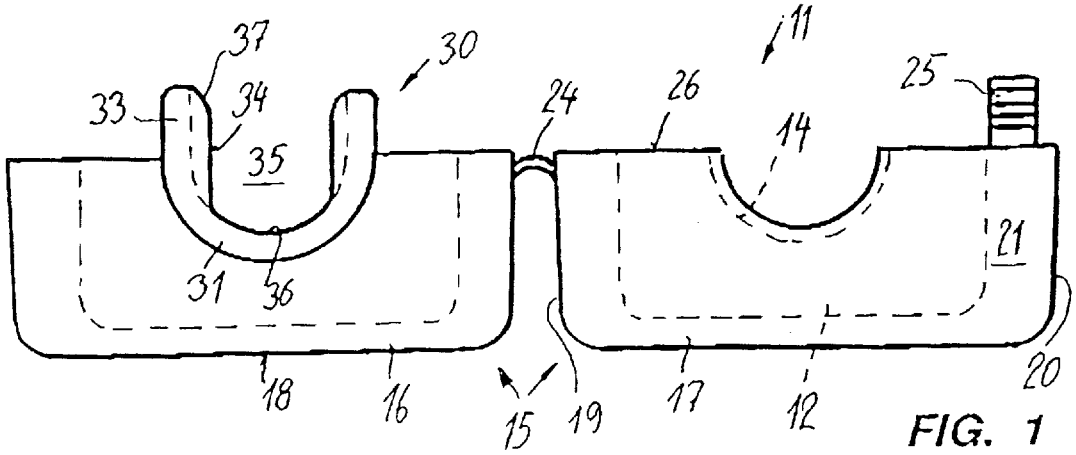
FIGS. 1 to 3 In each case a front view of the casing of a noise absorber in three successive assembly stages with a cable indicated in broken line form therein.
Figure 5:
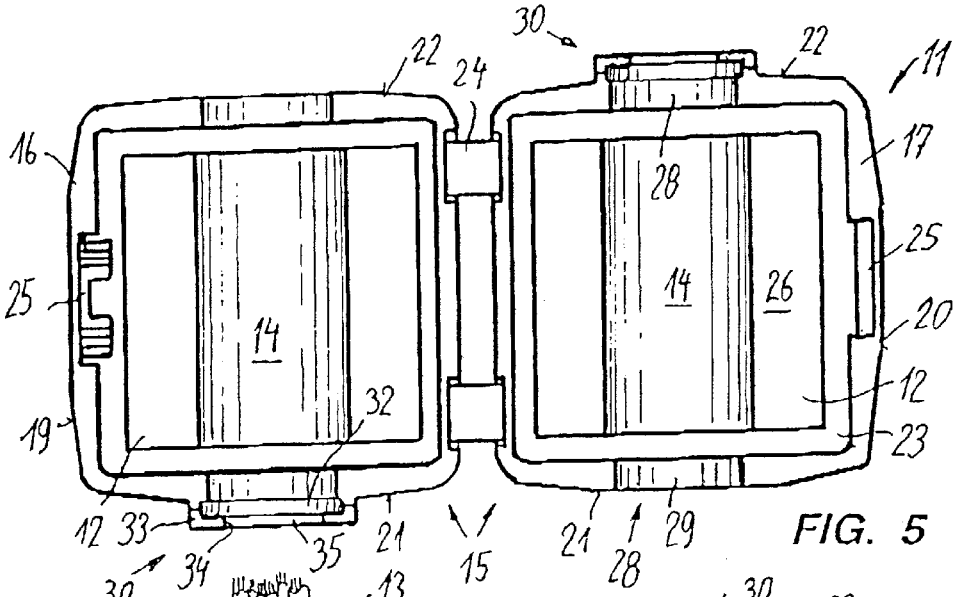
FIGS. 5 & 6 Plan views of the folded out casing halves of a noise absorber before and during assembly.
Figure 6:
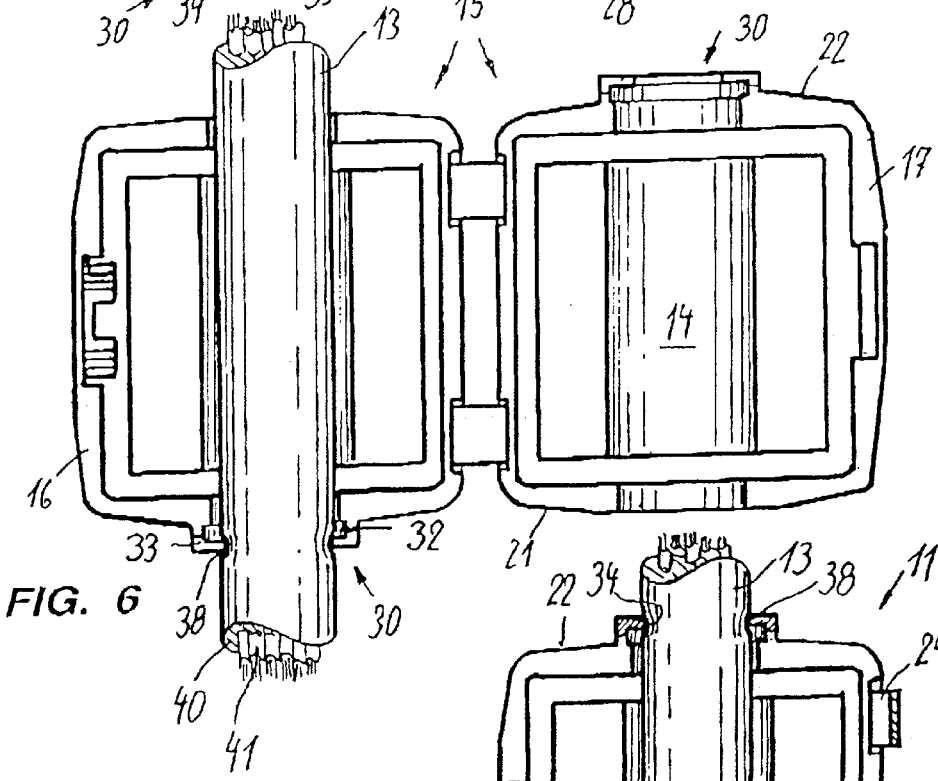
Figure 7:
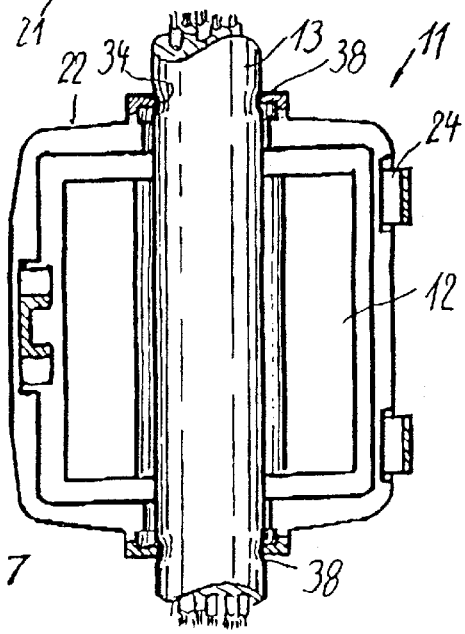
FIG. 7 A section along the casing parting line of the completely assembled noise absorber according to FIGS. 5 and 6.

The essential active element of the noise absorber 11 is constituted by the ferromagnetic material, usually ferrite material elements 12 intimated in broken line form in FIG. 1 and shown in plan view in FIGS. 5 to 7 and which are intended to embrace in an annular manner a cable 13 when they are joined together. Thus, they form half shells with cable duct recesses 14.

The elements 12 are placed in a casing 15 which, like the elements 12, is in two parts, so as to permit the subsequent fitting of the noise absorber to a cable which in certain circumstances may already be provided with connections or terminals. Thus, the casing comprises two part shells 16,17, which roughly split the casing in half. Each part shell has a bottom 18. side walls 19, 20 and end walls 21, 22. In not shown manner, the ferrite element 12 is fixed in the resulting casing recess 23, e.g. by wedging or in some other way. Both casing part shells 16, 17 are made in one piece from plastic injection moldings and are interconnected by two flexible strips 24, which form a type of film hinge. A locking mechanism 25 holds the two part shells together when pressed upon one another. It is provided with flexible notches on a projection engaging in corresponding opposing teeth on the other casing part shell. The casing 15 and the elements 12 are so matched to one another that in the assembled state the two surfaces 26 of the ferrite elements are in contact with one another along the casing parting line 27 in order to form a closed, ferromagnetic ring around the cable 13. In the vicinity of the casing parting line the casing part shells can slightly overlap one another through interengaging folds or the like so as to avoid any open gaps.

Adjacent to the casing parting lines 27, in the end walls 21, 22 of the casing part shells 16 are cut out semicircular openings which, when the casing is closed, create through openings 28 for the cable. They are aligned with the cable duct recesses 14 in the elements 12 and have roughly the same dimensions.

In FIGS. 1 to 4 in the vicinity of one of the through half-openings 29, which when joined together form the through opening 28, fixing means 30 are provided. A U-shaped projection 31 is shaped in front of the outer face 21 of the left-hand casing part shell 16 in FIGS. 1 and 2. With its lower U-arc or bow it is connected to the through half-opening 29. Its side legs 32 project upwards over the casing parting line 27 roughly by the depth of the through half-opening 29.

On their inside the legs 33 form two fixing edges 34. They pass perpendicular to the casing parting line 27 and constrict the extension of the through openings to which they substantially form chords. This leads to the fork or U-shape of the passage 35 of the fixing means 30 shown in FIGS. 1 to 3 and comprising two parallel fixing edges 34 and a lower bow 36 connecting the same, which substantially passes in the extension of the corresponding part of the through half-opening 29.

Figure 4:
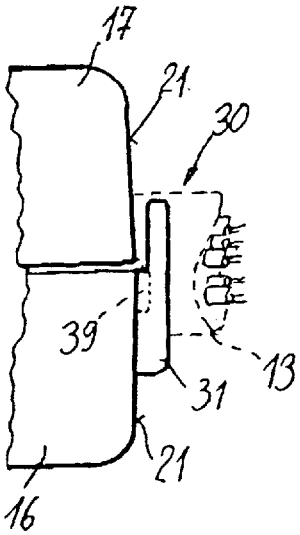
FIG. 4 A partial side view in the direction of arrow IV in FIG. 3.

FIG. 4 shows that the legs 33 pass at a distance in front of the front side 21 so as not to impede the folding together of the two halves.

FIGS. 5 and 6 show that the legs 33 in plan view have a L-shape, so that the relatively narrow fixing edges 34 are stiffened by the somewhat wider outer parts of the legs 33. The fixing edges 34 are substantially parallel to one another and flat, but do not have sharp edges. They are separated by a channel 32 from the through half-opening 29, as can be seen in FIG. 5. The upper angles or corners of the fixing edges are provided with fillets or chamfers 37 to facilitate cable insertion.

The embodiment according to FIGS. 5 to 7 differs from that according to FIGS. 1 to 4 only in that fixing means 30 are also provided on the second casing part shell 17 in the vicinity of the end face 22. Thus, when the casing part shells are folded up, they are displaced relative to one another in double homologous manner or diagonally. However, in the embodiment according to FIGS. 1 to 3 fixing means 30 are only provided in the area of end wall 21.

For fitting the noise absorber 11 to the cable 13 the following procedure is adopted:

In its manufacturing state the casing is opened with its two casing part shells 16, 17 (FIG. 1). In this state the ferrite material elements 12 are inserted in the casing recesses 23 and secured by the not shown fastening devices (cf. also FIG. 5). In a further assembly stage shown in FIGS. 2 and 6 the cable 13 is fitted from above on the casing half shell 16, in that it is vertically pressed into the passage 35. It comes into contact with the fixing edges 34 of the fixing means 30. As their mutual spacing is somewhat smaller than the cable diameter, flattened portions 38 are formed on two opposite points of the cable. There can be a simultaneous slight expansion of the legs 33 of the fork-shaped fixing means 30, because they, like the entire casing, are made from a flexible plastics material. The amount of said expansion can be adapted in accordance with requirements through the size and shape of the profile of the legs 33. A further flexibility could be created by cutting the legs 33 free from the end wall 21 over a certain height, as indicated by broken line 39 in FIG. 4.

Figure 2:
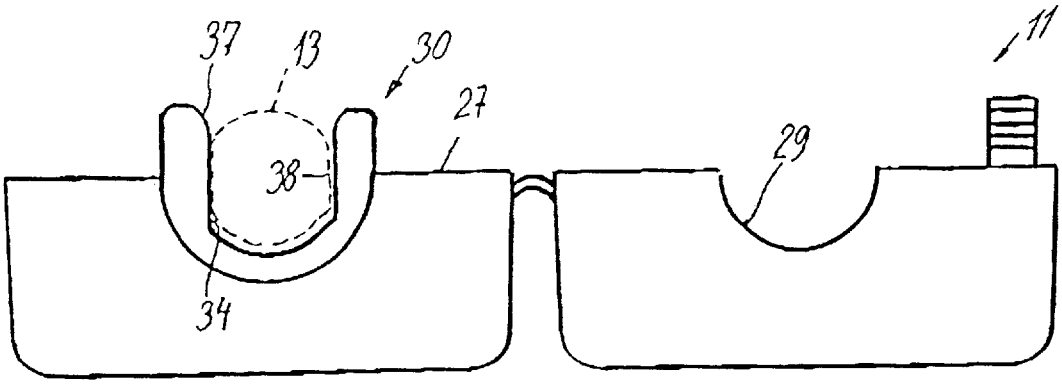

FIG. 2 shows that the shape and arrangement of the U-shaped fixing passage axially and radially fixes the cable in all directions to the casing part shell 16, so that it no longer needs to be secured between this and the following assembly step.

The next assembly step or stage (FIGS. 3, 4 and 7) comprises closing, i.e. folding together the casing part shells 16, 17. The casing part shell 17 is folded counterclockwise by 180°, the film hinge 24 bending correspondingly and the closure 25 locking in the corresponding counter recess and as a result the two half shells are joined together. In the construction according to FIGS. 1 to 4 this can completely take place without impediment by the cable or its fixing means. The two through half-openings 29 are placed free from forces over the cable, because they have a somewhat larger diameter than the latter. Correspondingly the surfaces 26 of the ferrite elements 12 can rest on one another without any slits. The casing parting line is not loaded with any compressive forces, which would attempt to expand or widen it. This simplifies the design of the closure and the hinge and makes it possible to choose for the casing a more flexible material, which is advantageous for its other functions (impact strength, etc.).

During assembly the construction according to FIGS. 5 to 7 has the advantage that the casing is so built up in double mirror symmetrical manner that it is unimportant in which of the two half shells the cable is inserted. Thus, no orientation or alignment of the half shells is necessary, which facilitates the first assembly step. The second assembly step of closing the casing half shells takes place in fundamentally the same way. Just prior to the closing of the half shells the fixing means are pressed over the cable, which requirements somewhat more force than in the construction according to FIGS. 1 to 3. However, after closing the half shells no permanent loading is left behind, because the fixing takes place by the force exerted on the cable by the fixing edges 34 of the legs 33 and which is independent of the closing force of the casing halves.

Figure 3:
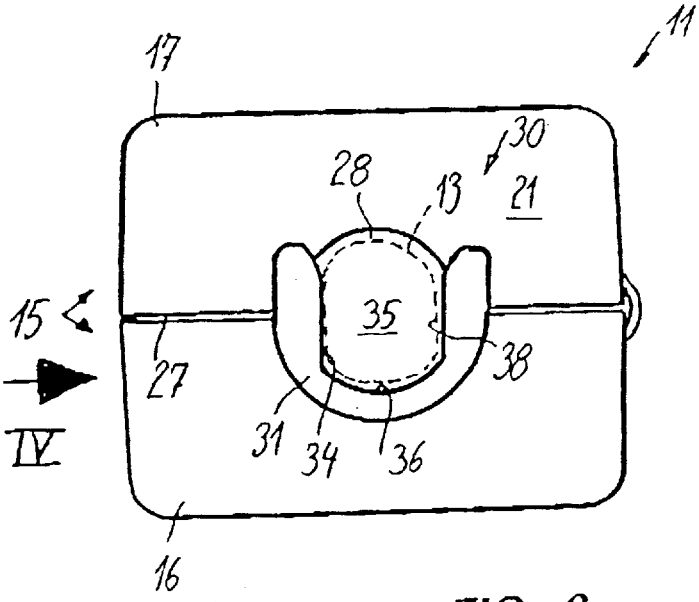

Normally one set of fixing means on one side of the casing is sufficient for a reliable fixing (FIGS. 1 to 3). In the case of fixing particularly flexible and easily displaceable cables, it would be possible to provide two sets of fixing means on the same casing part shell. Then on the second side the cable would not only be guided, but also fixed in the through opening 29. This can e.g. be appropriate if during assembly, following the insertion of the cable, transportation to a further assembly station is necessary.

It would also be possible, e.g. in FIG. 5, to provide fixing means on the right-hand casing half shell 17 in the vicinity of end wall 21. They would then have to be so displaced with respect to those on the casing half shell 16 that the legs 33 engage over one another in scissor-like manner. However, it is important that here again the same advantages are obtained, namely the definitive fixing prior to the closing of the casing half shells.

FIGS. 5 to 7 show that the fixing edges 34 only have to press flattened portions 38 into the cable insulating jacket 40. The self-insulated, single conductors 41 of the cable surrounded by the same can shift somewhat within the jacket. If it is necessary in the case of a very thick cable for the flattened portions to be more strongly impressed, then the cable jacket will also bulge somewhat upwards and downwards at this point, so that the cable then acquires a slightly oval cross-section.

Thus, the invention clearly leads to a pre-fixing of the cable to the noise absorber before closing the casing halves. This represents an important advantage at the time of assembly.

Figure 8:
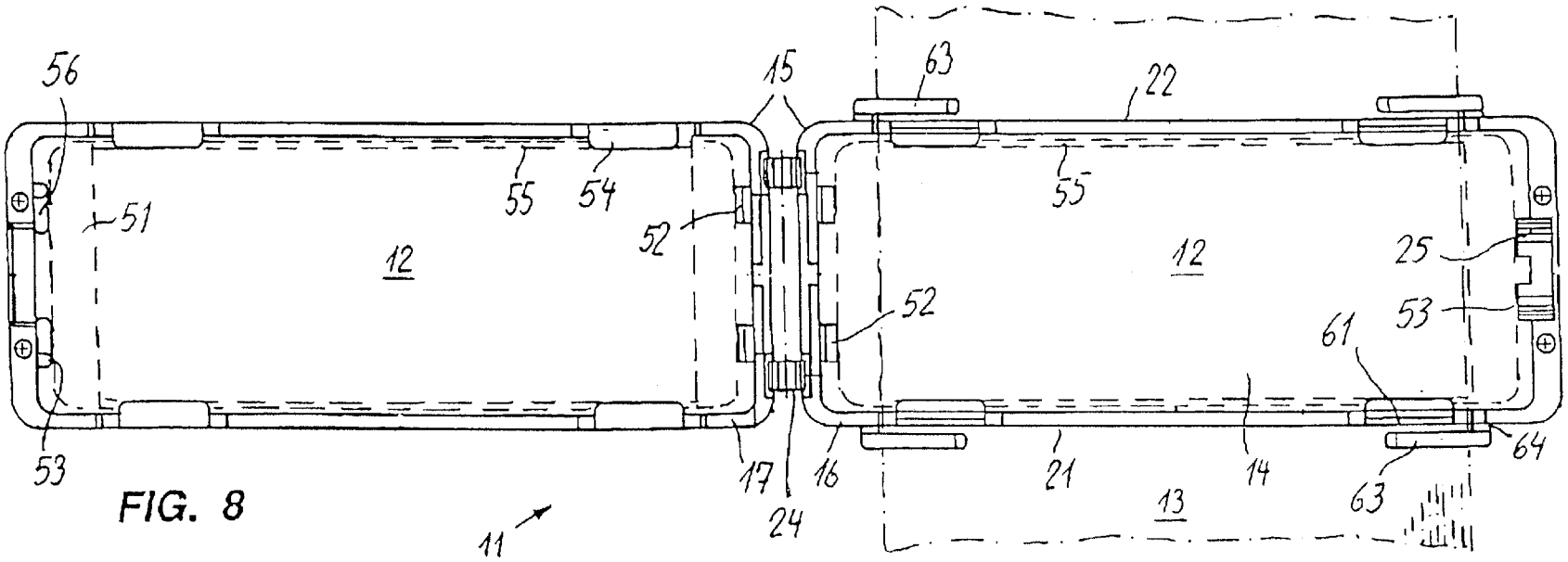
FIG. 8 A plan view of the opened casing part shells of a noise absorber for flat cables, FIG. 9 A part sectional view of the closed, noise absorber according to FIG. 8, which has not yet been fitted, with cables, seen from the end face.
Figure 9:
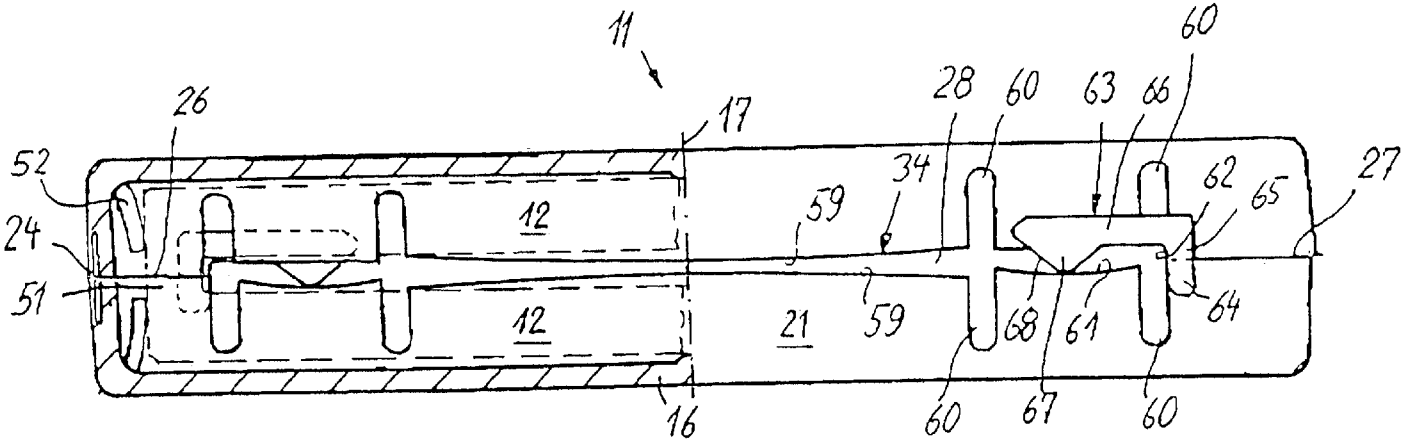
Figure 10:
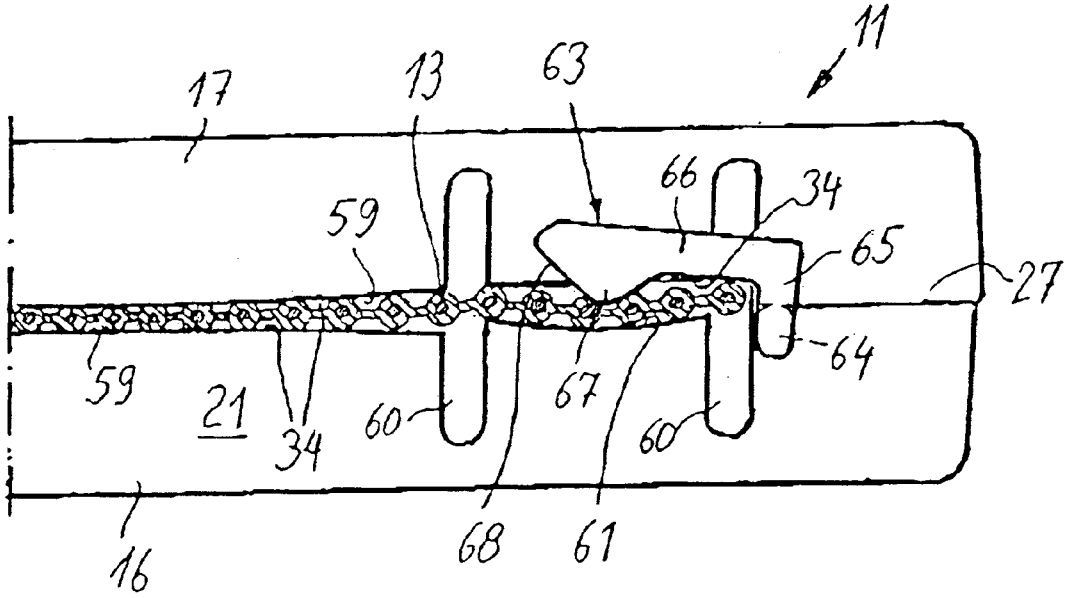
FIG. 10 A partial view of the end face with a sectionally shown flat cable.

FIGS. 8 to 10 show a noise absorber 11 for flat cables 13 (shown in dot-dash line form in FIG. 8). With the exception of the differences described, all the features and procedures of the previously described embodiment apply.

The casing part shells 16, 17 are shallow shell or box-shaped, because a very wide and thin flat strip cable 13 is to be received. Correspondingly the ferrite elements 22 (also in broken line form) are very shallow U-shaped and elongated in the transverse direction of the cable 13. Due to the limited thickness of the flat strip cable 13 the lateral U-legs 51, which are intended to close to a ring by engaging on one another the two ferrite elements, are very low (to the left in FIG. 9). The ferrite elements 12 are fitted into the casing halves and are pressed by the molded-on spring shackles 52 against stop cams 53 in order to fix the same in the transverse direction to the cable, while they are secured against dropping out of the casing part shells by snapping in or clamping under webs 54 on the elongated end faces 21, 22. The latter engage in the vicinity of a chamfer 55 provided on the ferrite element, so that they do not project over the surface of the shallow slot-like cable recess 14.

The locking mechanism 25 for locking the casing half shells 16, 17 to one another is constructed in accordance with the previously described embodiment and permits a locking in different, closely following locking positions. The individual locking teeth are provided on flexible tongues Inclined towards the casing parting line 27. The casing can be opened in that a two-armed key (not shown) is introduced through the openings in the facing casing part shell and the locking elements 25 are compressed in the opening position.

The passage openings 28 on both sides of the noise absorber and provided in the end faces 21, 22 formed from both casing half shells are very long in accordance with the flat cable construction (or wide with respect to the cable) and in accordance with the limited cable thickness are provided with small height dimensions. Over their fall circumference they form fixing edges 34, which are subdivided into several portions. In the central area of the cable passage opening 28 the resulting clamping gap 58 is bounded by two convexly approaching fixing edge portions 59. To this are connected on either side in the vicinity of the casing lower shell 16, separated from the portion 58 by a slot 60, a concave fixing edge portion 61. The latter is in turn separated by a slot 60 from the end 62 of the passage opening 28. The lateral ends adjacent to the slots 60 of the concave portion 61 project almost up to the plane of the casing parting line 27. Facing the latter on the casing cover side 17 there is a corresponding portion, but which has a greater spacing from the casing parting line plane and is straight and not concave, also being bounded by slots 60.

To the fixing means 30 belong a fixing element 63 in the form of an angle lever offset in two planes. It is shaped by means of a base portion 64 on the outer end wall 21 of the casing lower shell 16, from which passes an angle portion 65 transversely to the casing parting line 27 and beyond the same and to it is connected a lever portion 66. Close co its free end is shaped a cam 67 directed towards and beyond the casing parting line and which has a flat, wedge-shaped tip and towards the center of the passage opening an introduction bevel 68. In the unfitted state the lever portion 66 passes substantially parallel to the casing parting line and the cam 67 extends into the plane of the base of the concave fixing edge portion 61 but, as can be seen in FIG. 8, is slightly displaced with respect thereto in the cable longitudinal direction, because the complete fixing element 63 is placed with a, limited spacing in front of, i.e. outside the face 21, 22. A fixing element 63 is provided at each end of the passage opening 28 and at both faces, i.e. there are four in all.

As can be seen in FIG. 8, in the vicinity of the concave fixing edge portion 61 the fixing edge is relatively narrow, so that the surface pressure exerted by the elastically resilient, lever-like fixing elements 63 is somewhat greater in this area. However, the convex fixing edge portions 59 in both casing part shells and the surfaces of the webs 54 in the cover shell 17 are flat and wide, so that they give rise to a large-area clamping action.

The following procedure is adopted for assembly: In the casing part shells 16, 17 comprising a single plastic injection molding and interconnected by means of film hinges 24 are inserted the flat, U-shaped ferrite elements 12, which are locked or clamped between the webs 54, spring shackles 52 and stops 53. They are consequently fixed la assembly-proof manner to the casing halves.

Then the flat strip cable is firstly shoved on one side below the fixing element 63, the lever portion 66 being pivoted upwards (cf. FIG. 10) via the introduction bevel 68 and releasing a clamping gap between it, particularly its cam 67, and the concave fixing edge portion 61. The fixing element exerts a clamping force on the cable, which is produced by its elastic, resilient construction. In particular the base portion 64 acts in the manner of a torsion spring, whereas the angle portion 65 and lever portion 66 can act as spiral or bending springs.

FIG. 10 shows that the lateral edge 69 of the cable engages on the end 62 of the passage opening. As this takes place in the vicinity of both end faces 21, 22, the cable is fixed in the passage opening in a precisely oriented manner, it is very well fixed by the slight bending of the concave filing edge portion 61 into which it is pressed by the fixing element 63 even before the cover half 17 of the casing is closed.

Accompanied by a slight transverse bending the cable is then engaged in the same way under the two other fixing elements on the other side. With a noise absorber matching the flat cable width the cable is then precisely located in the slot-like passage opening of the ferrite elements. Thus, the cable is already fixed in assembly-proof manner to the casing lower half. The closing of the cover half 17 with a locking in of the locking elements 25 now joins together the noise absorber. The faces 26 at the end of the U-legs 51 of the ferrite elements come together and form the desired ring closure. In the vicinity of the convex fixing edge portions 59 there can also be a slight surface clamping on the central area of the cable and in particular ensures chat the cable cannot bend out.

FIG. 10 shows that the cable assumes a slight wave shape and the nose of the cam 67 is in most cases located will find a groove between the individual cable conductors in which it is inserted, but without damaging the insulation. The curvature of the cable at both end faces of the noise absorber 11 when it bends into the concave fixing edge portion 61, together with the intermediately assumed orientation in the passage opening between the ferrite halves aids the careful, damage-free retention.

I claim:

1. A method for assembling a noise absorber with an electric cable, the noise absorber having a casing partly split along a casing parting line, the casing including casing part shells foldable between an open and a closed state, the method comprising the steps of:

pre-assembling the noise absorber with the shells in the open state by locating an element of a material which at least partially damps electric noise in each of the shells;

inserting the cable along at least one longitudinal groove of the damping elements; and through at least one opening in an end wall of the shells;

fixing the cable to one of the casing part shells while the casing part shells are in the open state by inserting the cable between fixing edges of fixing means, the fixing edges defining at least one cable clamping gap, the fixing means situated outside an end wall of one of the casing part shells; and completing the assembling by closing the casing part shells to their closed state and locking them to each other so that the noise absorber is secured to the cable, wherein pressing the cable in between the fixing edges of the fixing means causes the casing to be fixed to the cable and secured against displacement in the axial direction of the cable, and whereby the fixing means are uninfluenced by the casing part shells in the closed state, so that the cable clamping gap is unchanged upon closing of the casing part shells.

2. The method according to claim 1, wherein on pressing the cable in the recess the cable is, over a short axial longitudinal portion thereof, deformed to an oval shape.

3. The method according to claim 1, wherein the fixing of the cable between the fixing edges is achieved by pressing the cable in a substantially vertical direction to the casing parting line, accompanied by deformation of the cable on two facing sides of the cable.

4. The method according to claim 1, wherein the cable is a flat strip cable and is fixed between the fixing edges by inserting the flat strip cable with at least one of its two outer rims substantially in the direction of the casing parting line.

5. The method according to claim 4, wherein the cable is fixed by inserting both rims between the fixing edges.

6. A noise absorber for absorbing electric noise comprising:

a) two elements made from an electric noise-damping material;

b) a casing for fixing the noise absorber on cables having thicknesses which vary in a predetermined range;

c) the casing comprising two casing part shells assemblable along a casing parting line, each receiving one of the electric noise damping elements;

d) the casing having an opening for the electric cable in at least one of two end walls in the assembled state;

e) fixing means for fixing the casing to the cable which define at least one cable clamping gap;

f) the fixing means having at least two facing fixing edges, wherein the fixing edges have a spacing therebetween at the cable clamping gap which is smaller by a predetermined amount than the corresponding thickness of the smallest cable in said predetermined thickness range; wherein g) the cable is insertable into the cable clamping gap while the casing half shells are open to fix the casing to the cable such that the spacing of the fixing edges is slightly increased by insertion of the cable;

h) the fixing of the cable is maintained when the casing half shells are closed;

i) the fixing means are situated outside both casing part shell end walls; and j) the fixing means are uninfluenced by the casing part shells in their closed state, leaving the gap unchanged upon closing the shells.

7. The noise absorber according to claim 6, wherein the fixing edges of at least one of the casing part shells project over and beyond the casing parting line in the direction of the facing casing part shell.

8. The noise absorber according to claim 7, wherein the fixing edges of said at least one casing part shell project over and beyond the casing parting line in the direction of the facing casing part shell up to a rim of the passage opening remote from the casing parting line in the opposite casing part shell.

9. The noise absorber according to claim 6, wherein the fixing edges are flexibly resilient over at least one area of their length.

10. The noise absorber according to claim 6, wherein the fixing edges are flexible in an area extending over the casing parting line.

11. The noise absorber according to claim 6, wherein the fixing edges are substantially parallel to one another.

12. The noise absorber according to claim 6, wherein the fixing edges are situated outside the area of the casing passage opening and are spaced from the casing passage opening in front of the outer end wall of the casing.

13. The noise absorber according to claim 6, wherein the fixing edges are provided on a casing portion that is L-shaped in a cross-section parallel to the casing parting line.

14. The noise absorber according to claim 6, wherein the fixing edges are smooth and untoothed.

15. The noise absorber according to claim 6, wherein the fixing edges are narrow and flat.

16. The noise absorber according to claim 6, wherein the fixing edges are rounded.

17. The noise absorber according to claim 6, wherein the cable clamping gap is constructed between two legs as a fork-like projection in front of an outer end wall of the casing, only being connected in one piece to one of the casing part shells.

18. The noise absorber for absorbing electric noise according to claim 6, wherein a portion of one of the fixing edges in provided on a lever-like fixing element which is substantially parallel to the casing parting line.

19. The noise absorber according to claim 18, wherein the fixing element has a cam-like projection with an introduction bevel.

20. The noise absorber according to claim 18, wherein the fixing element is pivotable in elastically resilient manner about a fixing portion on one of the casing halves.

21. The noise absorber for absorbing electric noise according to claim 6, wherein a fixing element is in each case located at the end of the cable clamping gap, which is elongated in the direction of the casing parting line, for fixing the lateral areas of a flat strip cable.

22. The noise absorber according to claim 21, wherein the fixing element is positioned facing a concavely constructed arcuate portion of the particular fixing edge on which the fixing element is shaped.

23. The noise absorber according to claim 21, wherein the fixing element in the vicinity of the arcuate portion the fixing edge is narrow, whereas in the remaining area of the cable clamping gap it is wider.

24. The noise absorber according to claim 21, wherein all the fixing elements are provided on one of the casing part shells.

25. The noise absorber according to claim 6, wherein a set of fixing edges is provided on a first one of the casing part shells only in the vicinity of a first one of casing end faces.

26. The noise absorber according to claim 25, wherein on the second one of the casing part shells there is a set of fixing edges on a second one of the casing end faces.

27. The noise absorber according to claim 6, wherein both casing part shells and joining hinges, a closing device and the fixing means are made from a unitary plastic injection molding piece.

28. The noise absorber according to claim 6, wherein the noise damping material elements are made from ferrite material.

* * * * *